US011607097B2

(12) United States Patent
Burke et al.

(10) Patent No.: US 11,607,097 B2
(45) Date of Patent: Mar. 21, 2023

(54) VACUUM CLEANER ATTACHMENT WITH FLOATING CLEANING ELEMENT AND SURFACE CLEANING APPARATUS INCLUDING THE SAME

(71) Applicant: SharkNinja Operating LLC, Needham, MA (US)

(72) Inventors: Brian Burke, Barrington, RI (US); William Liberis, Somerville, MA (US); Jason B. Thorne, Wellesley Hills, MA (US); Charlie Cai, Wuhan (CN); Peter Hutchinson, Suzhou (CN); Andre D. Brown, Natick, MA (US); Kai Xu, Suzhou (CN); Brian M. Bond, Woburn, MA (US)

(73) Assignee: SharkNinja Operating LLC, Needham, MA (US)

( * ) Notice: Subject to any disclaimer, the term of this patent is extended or adjusted under 35 U.S.C. 154(b) by 417 days.

(21) Appl. No.: 16/571,529

(22) Filed: Sep. 16, 2019

(65) Prior Publication Data

US 2020/0008635 A1 Jan. 9, 2020

Related U.S. Application Data

(63) Continuation of application No. 14/976,257, filed on Dec. 21, 2015, now Pat. No. 10,413,144.
(Continued)

(51) Int. Cl.

| | |
|---|---|
| ***A47L 9/06*** | (2006.01) |
| ***A47L 9/00*** | (2006.01) |
| ***A47L 9/30*** | (2006.01) |

(52) U.S. Cl.
CPC ..... *A47L 9/0673* (2013.01); *A47L 9/009* (2013.01); *A47L 9/0666* (2013.01); *A47L 9/30* (2013.01)

(58) Field of Classification Search
CPC ..... A47L 9/0673; A47L 9/009; A47L 9/0666; A47L 9/30; A47L 5/28; A47L 5/30; A47L 9/02; A47L 9/04; A47L 9/06
(Continued)

(56) References Cited

U.S. PATENT DOCUMENTS 6,591,447 B2 * 7/2003 Wegelin ..... A47L 5/34 15/359
7,137,169 B2 11/2006 Murphy et al.
(Continued)

OTHER PUBLICATIONS

Chinese Office Action/English translation dated Sep. 9, 2019, received in Chinese Patent Application No. 201580073939.3, 12 pgs.

*Primary Examiner* — Joseph J Hail
*Assistant Examiner* — Caleb Andrew Holizna
(74) *Attorney, Agent, or Firm* — Grossman Tucker Perreault & Pfleger, PLLC

(57) ABSTRACT

A vacuum cleaner attachment generally includes a cleaning element that floats relative to a suction conduit of the vacuum cleaner attachment. The cleaning element is supported on a support structure that is movably coupled to a housing and is biased towards a floor, for example, as a result of the weight of the cleaning element support structure. The cleaning element may be permanently attached to the support structure or may be a removable or disposable pad or sheet attached to the support structure. The floating cleaning element may be supported between the suction conduit and one or more wheels of the vacuum cleaner attachment. The vacuum cleaner attachment may be removably attached to a vacuum cleaner, for example, to be used interchangeably with other surface cleaning heads.

24 Claims, 8 Drawing Sheets

Related U.S. Application Data

(60) Provisional application No. 62/214,034, filed on Sep. 3, 2015, provisional application No. 62/094,118, filed on Dec. 19, 2014.

(58) Field of Classification Search
USPC ..... 15/415.1
See application file for complete search history.

(56) References Cited

U.S. PATENT DOCUMENTS

| | | | | |
|---|---|---|---|---|
| 7,246,405 | B2 | 7/2007 | Yan | |
| 8,302,248 | B2 | 11/2012 | Chavana, Jr. et al. | |
| D681,899 | S | 5/2013 | Bilger et al. | |
| 9,027,198 | B2 | 5/2015 | Conrad | |
| 9,192,271 | B2 | 11/2015 | Dekkers et al. | |
| 9,211,045 | B2 | 12/2015 | Li et al. | |
| 9,648,999 | B2 | 5/2017 | Uphoff et al. | |
| 9,661,971 | B2 | 5/2017 | Riehl | |
| 2007/0157418 | A1* | 7/2007 | Zahuranec | A47L 5/30 15/328 |
| 2009/0083937 | A1* | 4/2009 | Vander Baan | A47L 5/34 15/419 |
| 2011/0010889 | A1* | 1/2011 | Arthey | A47L 9/02 15/415.1 |
| 2014/0033469 | A1* | 2/2014 | Toole | A47L 9/0686 15/415.1 |
| 2014/0237752 | A1* | 8/2014 | Conrad | A47L 9/2826 15/319 |
| 2014/0245561 | A1 | 9/2014 | Pi et al. | |
| 2014/0283332 | A1* | 9/2014 | Conrad | A47L 5/30 15/389 |
| 2014/0331445 | A1 | 11/2014 | Thorne et al. | |

* cited by examiner

VACUUM CLEANER ATTACHMENT WITH FLOATING CLEANING ELEMENT AND SURFACE CLEANING APPARATUS INCLUDING THE SAME

CROSS-REFERENCE TO RELATED APPLICATIONS

This application is a continuation of co-pending U.S. patent application Ser. No. 14/976,257, filed on Dec. 21, 2015, which claims the benefit of U.S. Provisional Patent Application Ser. No. 62/094,118, filed on Dec. 19, 2014, and U.S. Provisional Patent Application Ser. No. 62/214,034, filed on Sep. 3, 2015, each of which are fully incorporated herein by reference.

TECHNICAL FIELD

The present invention relates to vacuum cleaners and more specifically to vacuum cleaner attachments.

BACKGROUND INFORMATION

The following is not an admission that anything discussed below is part of the prior art or part of the common general knowledge of a person skilled in the art.

A surface cleaning apparatus, more commonly known as a vacuum cleaner or vacuum, may be used to clean a variety of surfaces using at least suction. Various types of vacuum cleaners are known including, without limitation, upright vacuum cleaners, canister vacuum cleaners, stick vacuum cleaners, and central vacuum systems. A vacuum cleaner typically includes a surface cleaning head with a dirty air inlet. Some vacuum cleaners include some or all of the operating components (e.g., the suction motor and the air treatment system) at a location other than the surface cleaning head to enable the surface cleaning head to be lighter or smaller. An upright vacuum cleaner, for example, may include an upright section containing at least an air treatment system and mounted to a surface cleaning head. A canister vacuum cleaner may include a canister body containing at least an air treatment system and a suction source (e.g., a suction motor) that is connected to a surface cleaning head by a flexible hose and a handle. Another type of vacuum cleaner includes the suction motor and the air treatment system (e.g., one or more cyclones) positioned in the surface cleaning head.

A surface cleaning apparatus, such as any of the vacuum cleaners mentioned above, may also use one or more cleaning sheets or pads. Examples of surface cleaning heads using both suction and cleaning sheets or pads are disclosed in U.S. Design Pat. No. 681,899 and U.S. Patent Application Pub. No. 2014/0331445, which are commonly owned and incorporated herein by reference. While using these surface cleaning heads, the cleaning sheets or pads generally collect debris while sliding across a cleaning surface together with the suction conduit or nozzle. In the surface cleaning heads where the cleaning sheet or pad is fixed relative to the suction conduit or nozzle, however, the force exerted on the cleaning sheet or pad may not be appropriate to ensure that the cleaning sheet or pad collects debris from the surface to be cleaned. The problem of exerting an appropriate amount of force is further exacerbated when the surface to be cleaned is uneven. An uneven surface may cause the suction conduit or the cleaning sheet or pad to lose contact with the surface and thus reduce the cleaning effectiveness.

SUMMARY

Consistent with one aspect, a vacuum attachment includes a housing including at least one suction conduit having a dirty air inlet and a support structure adjustably engaged with the housing. The support structure is configured to have a cleaning element attached thereto. At least a first bias mechanism is configured to bias the support structure away from the housing such that the support structure floats with respect to the housing during use on a surface being cleaned.

Consistent with another aspect, a vacuum attachment includes a housing including at least one suction conduit having at least one dirty air inlet and at least one wheel coupled to the housing. The at least one wheel and the at least one suction conduit are configured to contact a surface being cleaned. A cleaning element support structure is suspended below the housing and located between the at least one dirty air inlet and the at least one wheel. The cleaning element support structure being configured to support a cleaning element. A sliding coupling mechanism couples the cleaning element support structure to the housing such that the cleaning element support structure moves relative to the housing. The sliding coupling mechanism includes at least one elongate element on at least one of the support structure and the housing. The elongate element slideably engages an aperture on the other of the support structure and the housing.

Consistent with a further aspect, a surface cleaning apparatus includes a main cleaning head including a dirty air inlet and an alternate surface cleaning head configured to replace the main cleaning head. The alternate surface cleaning head includes a housing including at least one suction conduit having at least one dirty air inlet and a cleaning element support structure suspended below the housing and floating relative to the housing and suction conduit. The cleaning element support structure is configured to support a cleaning element. The surface cleaning apparatus also includes an upright section selectively connectable to each of the main cleaning head and the alternate surface cleaning head. The upright section is movable between a storage position and a rearward in-use position, when mounted to each of the main cleaning head and the alternate surface cleaning head. The surface cleaning apparatus further includes a flexible hose forming at least a portion of an airflow path and selectively connectable to the main cleaning head and the alternate cleaning head and a suction motor and an air treatment system in fluid communication with the flexible hose and positioned in the airflow path.

BRIEF DESCRIPTION OF THE DRAWINGS

These and other features and advantages will be better understood by reading the following detailed description, taken together with the drawings, wherein.

DETAILED DESCRIPTION

A vacuum cleaner attachment (or vacuum attachment), consistent with embodiments of the present disclosure, generally includes a cleaning element that floats relative to a suction conduit of the vacuum cleaner attachment. The cleaning element is supported on a support structure that is movably coupled to a housing and is biased towards a floor, for example, as a result of the weight of the cleaning element support structure. The cleaning element may be permanently attached to the support structure or may be a removable or disposable pad or sheet attached to the support structure. The floating cleaning element may be supported between the suction conduit and one or more wheels of the vacuum cleaner attachment. The vacuum cleaner attachment may be removably attached to a vacuum cleaner, for example, to be used interchangeably with other surface cleaning heads.

The vacuum cleaner attachment may be used with various types of vacuum cleaners including, but not limited to, upright vacuum cleaners, canister vacuum cleaners, stick vacuum cleaners, and central vacuum cleaners. When attached, the vacuum cleaner attachment is fluidly connected to a suction source (e.g., a suction motor) and/or an air treatment system (e.g., a cyclone and/or filter). In operation, the vacuum cleaner generates suction within the suction conduit, drawing debris from a surface into the suction conduit. Once the debris reaches the suction conduit, the debris passes through a dirty air inlet to an airflow or suction path that leads to a debris collection apparatus such as a bag or a canister. The floating cleaning element, consistent with embodiments of the present disclosure, may be used to collect some, or all, of the residual debris that remains after the suction conduit passes over the area to be cleaned, thereby improving the cleaning effectiveness. By floating relative to the suction conduit of the vacuum cleaner attachment, the contact between the cleaning element and the surface being cleaned may be improved.

To promote usability, the vacuum cleaner attachment including a floating cleaning element may be used as an alternate surface cleaning head replacing the main surface cleaning head of the vacuum cleaner. By allowing for interchangeability, the vacuum cleaner attachment may thus enhance the functionality of existing vacuum cleaners and allow the vacuum cleaner to be used for additional surface cleaning operations.

Figure 1A:
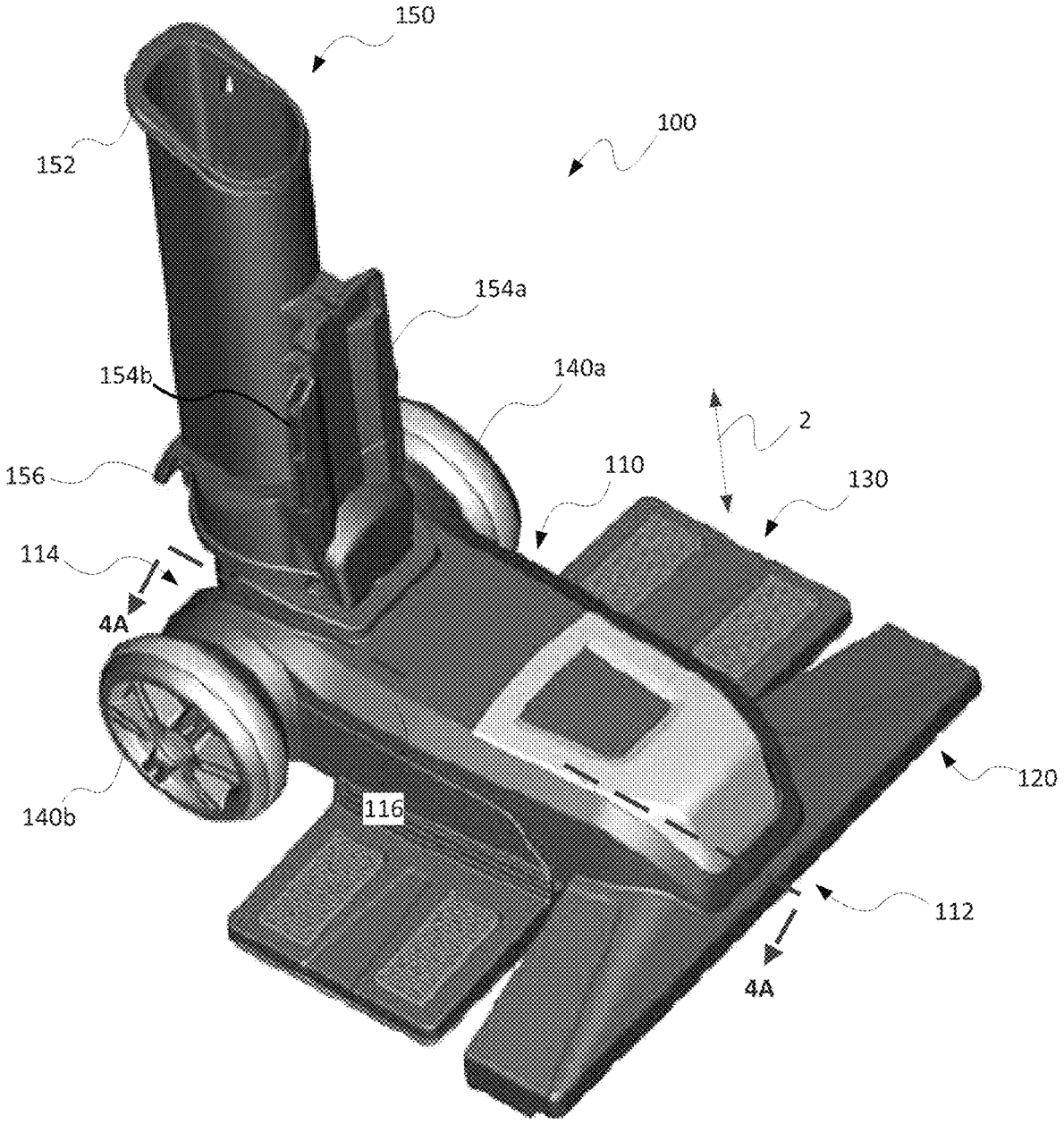
FIG. 1A is a vacuum cleaner attachment with a floating surface cleaning element, consistent with embodiments of the present disclosure.
Figure 1B:
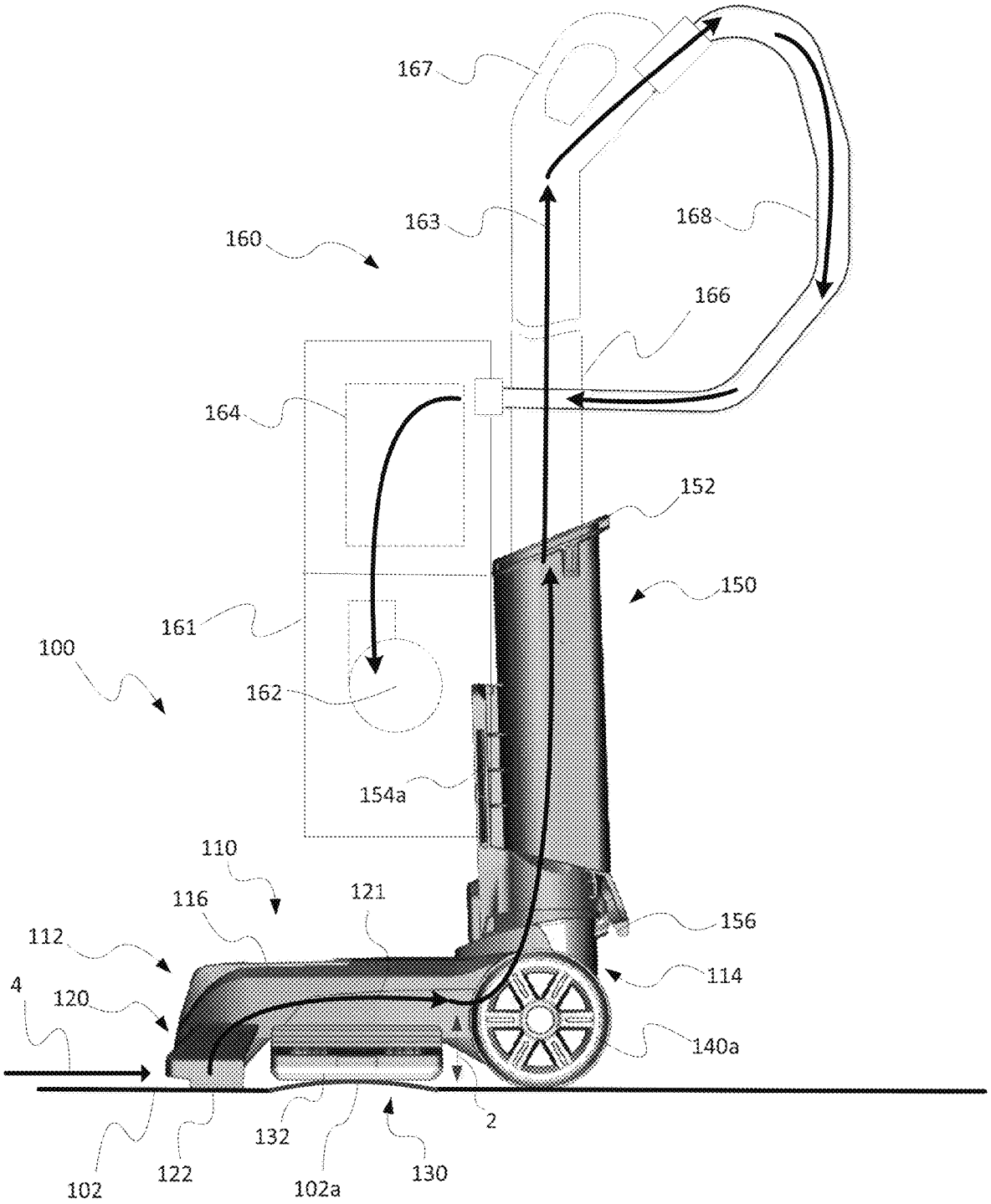
FIG. 1B is a side view of a vacuum cleaner with the vacuum cleaner attachment shown in FIG. 1A.

Referring to FIGS. 1A and 1B, an embodiment of a vacuum cleaner attachment 100 is shown and described in greater detail. The vacuum cleaner attachment 100 generally includes a housing 110, a suction conduit 120 at a front end 112 of the housing 110, and a cleaning element support structure 130 movably coupled to the housing 110. The cleaning element support structure 130 is movable relative to the housing 110 and the suction conduit 120 in a direction (as shown by arrow 2) generally perpendicular to a surface 102 being cleaned. In this embodiment, the surface cleaning element support structure 130 generally extends along the length of the suction conduit 120 and is located behind the suction conduit 120. In other embodiments, a cleaning element support structure may be located in front of the suction conduit, cleaning element supports structures may be located in front of and in back of the suction conduit, or a cleaning element support structure may be located between two suction conduits.

As shown in FIG. 1B, the cleaning element support structure 130 includes a cleaning element 132, such as a sheet or pad, on a bottom side thereof. The cleaning element 132 generally contacts the surface 102 during use to collect debris. In this embodiment, the weight of the support structure 130 acts as a biasing mechanism to bias the support structure 130 toward the surface 102 until the cleaning element 132 contacts the surface 102. Because the support structure floats relative to the housing 110, the support structure 130 moves in the direction of arrow 2 as the contour of the surface 102 changes and thus may remain in contact with the surface 102. As shown, for example, the support structure 130 rises over a raised section 102*a* of the surface 102 such that the suction conduit 120 and the surface cleaning element 132 both remain in contact with the surface 102. Similarly, the support structure 130 may lower beneath the suction conduit 120 to remain in contact with a lower section (not shown) of the surface 102.

Figure 3:
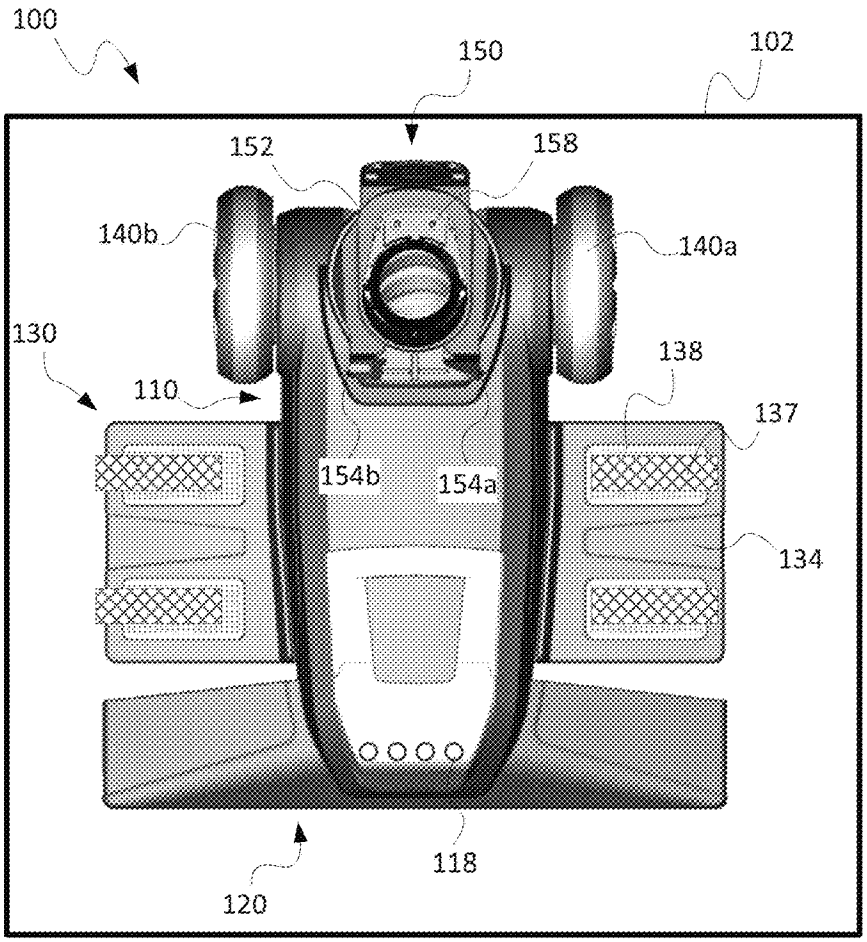
FIG. 3 is a top view of the vacuum cleaner attachment shown in FIG. 1A with a cleaning pad attached.
Figure 2:
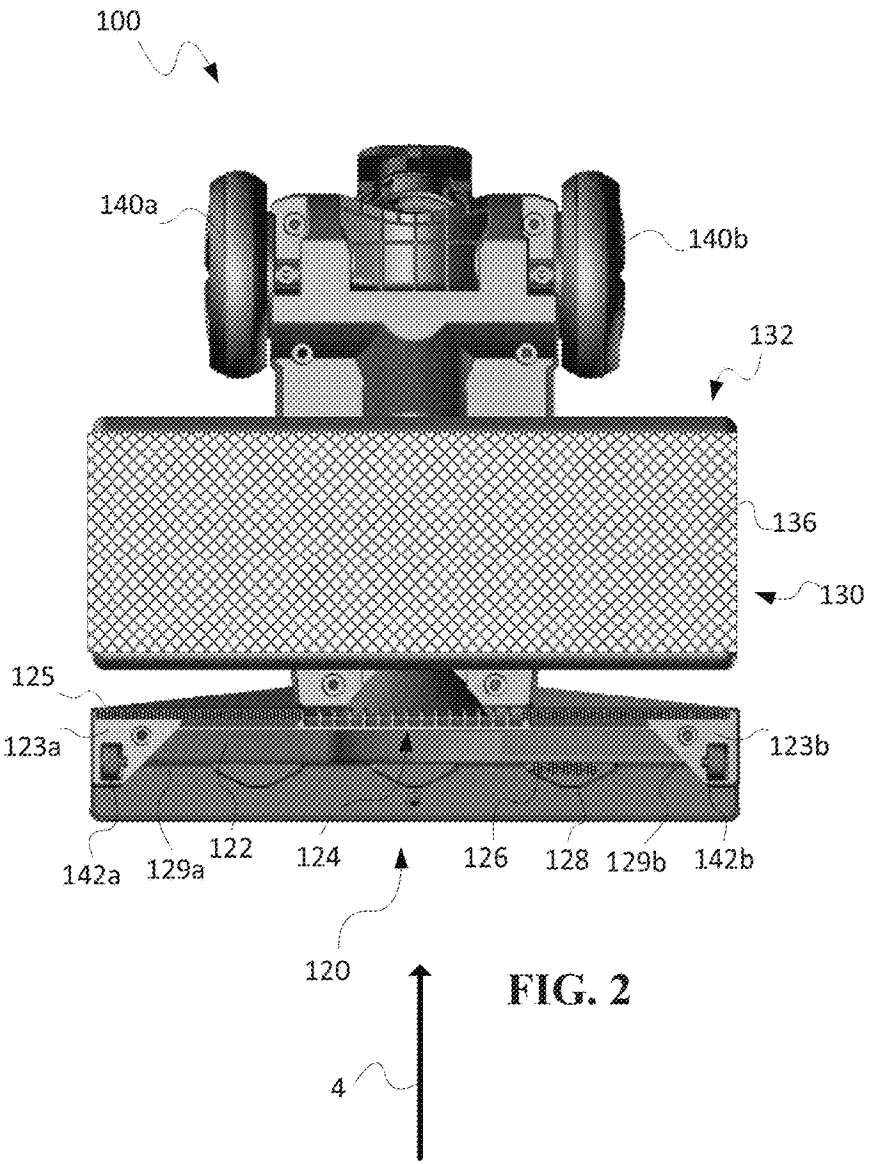
FIG. 2 is a bottom view of the vacuum cleaner attachment shown in FIG. 1A with a cleaning pad attached.

As shown in FIGS. 2 and 3, the surface cleaning element 132 may include a removable pad or sheet 136 removably attached to the support structure 130. The pad or sheet 136 may be affixed to the support structure 130 using any type of attachment mechanisms or fasteners including, without limitation, a hook-and-loop fastener (e.g., Velcro®), clips, adhesives, snaps, buttons, or any other attachment mechanisms. In the illustrated embodiment, the support structure 130 includes one or more attachment regions 138 (e.g., Velcro® fastener strips) that attach to mating attachment portions 137 extending from the pad or sheet 136. Alternatively (or additionally), the cleaning pad 136 may include drawstrings, an elastic material, an adhesive material, or any other like method of attachment. For example, the use of an elastic material would allow the cleaning pad 136 to be attached to the support structure 130 without using attachment regions on the support structure 130. The cleaning pad 136 may be reusable or disposable. In other embodiments, the cleaning pad 136 may be permanently integrated into the support structure 130.

The cleaning pad 136 may be made from any material capable of removing and/or collecting debris from the surface 102. For example, the cleaning pad 136 may be made of fabric, nylon, elastomers, paper, organic fibers, synthetic fibers, abrasive materials, or any other material. The cleaning pad 136 may also be made of an absorbent material, for example, for use in applications involving liquid on the surface 102.

As shown in FIG. 2, the suction conduit 120 includes a bottom opening 122 on a bottom side that extends along a substantial portion of the suction conduit 120 and a dirty air inlet 124 such that debris passes through the bottom opening 122 and into the dirty air inlet 124. The dirty air inlet 124 is fluidly coupled to a suction path 121 through the housing 110 (see FIG. 1B). The suction conduit 120 may further include bristles, castellations, and/or cleaning pads on the bottom side to facilitate capturing debris in the suction conduit 120 before reaching the cleaning pad 136 and thus to avoid frequent replacement of the cleaning pad 136.

As shown, one or more bristle strips 125 may be located on a bottom side of the suction conduit 120 behind the bottom opening 122 and along at least a portion of the opening 122. Bristle strips 126 may also be located on one or more castellations 128 located along the bottom opening 122 on the front section of the suction conduit 120. The bristle strips 126 may dislodge debris from the surface 102 and allow the debris to enter the bottom opening 122 and pass through the dirty air inlet 124 into the suction path 121. The castellations 128 may be shaped to allow larger debris to enter the suction conduit 120, for example, angled with a front edge smaller than a rear edge (e.g., a triangular or trapezoidal shape). The suction conduit 120 may also include angled structures 129*a*, 129*b* at the sides to direct debris into the bottom opening 122. The suction conduit 120 may further include cleaning pads 123*a*, 123*b* on the bottom of the suction conduit 120 at the sides to assist with edge cleaning.

This embodiment of the vacuum cleaner attachment 100 also includes wheels 140*a*, 140*b* and a neck 150 at a rear end 114 of the housing 110 with the cleaning element support structure 130 supported between the wheels 140*a*, 140*b* and the suction conduit 120. The wheels 140*a*, 140*b* and the suction conduit 120 are configured to contact the surface 102 while the support structure 130 floats relative to the suction conduit 120 and the wheels 140*a*, 140*b*. Although two wheels are shown in the illustrated embodiment, a vacuum cleaner attachment, consistent with the present disclosure, may also include only one wheel or other rolling mechanisms (e.g., a ball) or support structures configured to slide along the surface being cleaned. In the illustrated embodiment, wheels 142*a*, 142*b* are also located on the bottom of the suction conduit 120 to assist with maneuverability. Instead of the wheels 142*a*, 142*b*, the suction conduit 120 may slide on the cleaning pads 123*a*, 123*b*.

The neck 150 extends from a top portion 116 of the housing 110 and may be pivotably coupled to the housing 110. The neck 150 may also be coupled using a mechanism that permits sideways pivoting, for example, as disclosed in U.S. Patent Application Pub. No. 2014/0331445, which is fully incorporated herein by reference. The neck 150 is configured to be attached to a vacuum cleaner and to fluidly couple the vacuum cleaner attachment 100 to a suction source. The suction path 121 thus extends from the bottom opening 122 on the suction conduit 120 through the housing 110 and the neck 150 (see FIG. 1B). The suction path 121 may be formed by flexible and/or rigid conduits located in the housing 110 and neck 150, as will be described in greater detail below.

As shown in FIG. 1B, the neck 150 is configured to be coupled to an upright section 160 of a canister or upright vacuum cleaner. The upright section 160 includes a canister 161 containing a suction source 162 (e.g., a suction motor) and an air treatment system 164 (e.g., one or more cyclones, filters and/or debris collectors) and a wand 166. The wand 166 includes a handle 167 for maneuvering the vacuum cleaner and a suction path 163 that is fluidly coupled to the suction path 121 extending from the suction conduit 120 through the housing 110. A suction hose 168 may be fluidly coupled between the wand 166 and the canister 161.

One example of a canister or upright vacuum that may be used with the vacuum attachment 100 is described in greater detail in U.S. Patent Application Pub. No. 2014/0331445. The neck 150 may also be configured to be coupled to a wand of a stick type vacuum having the suction source and air treatment system located next to the handle, for example, as disclosed in U.S. Pat. No. 9,027,198, which is incorporated herein by reference.

The neck 150 generally includes first and second mounting mechanisms for coupling to the wand 166 and the canister 161, respectively. In the illustrated embodiment, the first mounting mechanism includes a cowl 152 configured to receive the wand 166 and the second coupling mechanism includes wings 154*a*, 154*b* for engaging and supporting the canister 161. Alternatively or additionally, the neck 150 may also include other mounting mechanisms for mounting the wand 166, the canister 161 and/or other components of the upright section 160.

The cowl 152 may be shaped and configured to assist in aligning the wand 166 and in preventing the rotation of the wand 166 within the neck 150. The cowl 152 may also be directly coupled to the handle 167 and/or the hose 168 or any other flexible or rigid conduit fluidly coupled to a suction source. Inside the cowl 152, the neck 150 may include electrical connectors 158 (see FIG. 3) for mating with electrical connectors on the wand 166 to provide a power source to the vacuum cleaner attachment 100, for example, to power lights.

The wings 154*a*, 154*b* extend laterally from the neck 150 to receive the canister 161 and may have various shapes. The upright section 160 (e.g., the canister 161) may include recesses that receive the wings 154*a*, 154*b* on the neck 150 and/or may include releasable latches for engaging the wings 154*a*, 154*b*. The neck 150 may further include a hook 155 for connecting the vacuum attachment 100 to a structure, such as a wheeled caddy, for storage.

Although the neck 150 is shown with a particular size and shape, other sizes, shapes and configurations are within the scope of the present disclosure. Other types of mounting mechanisms may be used, for example, to attach to a wand, a canister, or any component of an upright section of a vacuum cleaner. A vacuum attachment, consistent with the present disclosure, may also be configured to be coupled to a wand or hose of a vacuum cleaner without using a neck. The wand or hose may be coupled, for example, directly to the rear end 114 of the housing 110.

The vacuum cleaner attachment 100 may further include one or more lights 118 such as light emitting diodes (LEDs), for example, on the front end 112 of the housing 110 to assist with cleaning. The lights 118 may also be located on the suction conduit 120 or other locations. The lights 118 may be coupled to a power source (e.g., in the upright section 160) by being electrically coupled to the upright section when the attachment 100 is mounted thereto. In the illustrated embodiment, the electrical connection is made via the electrical connectors 158 in the neck 150 mating with corresponding electrical connectors in the wand 166, the handle 167, or the hose 168.

Figure 4A:
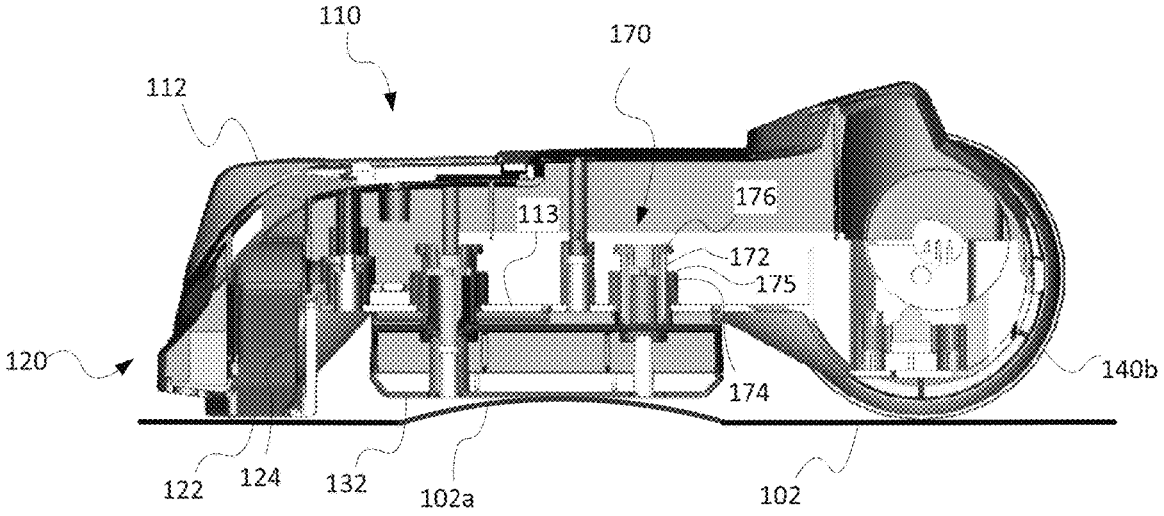
FIG. 4A is a cross-sectional view of the vacuum cleaner attachment shown in FIG. 1A taken along line 4A-4A.
Figure 4B:
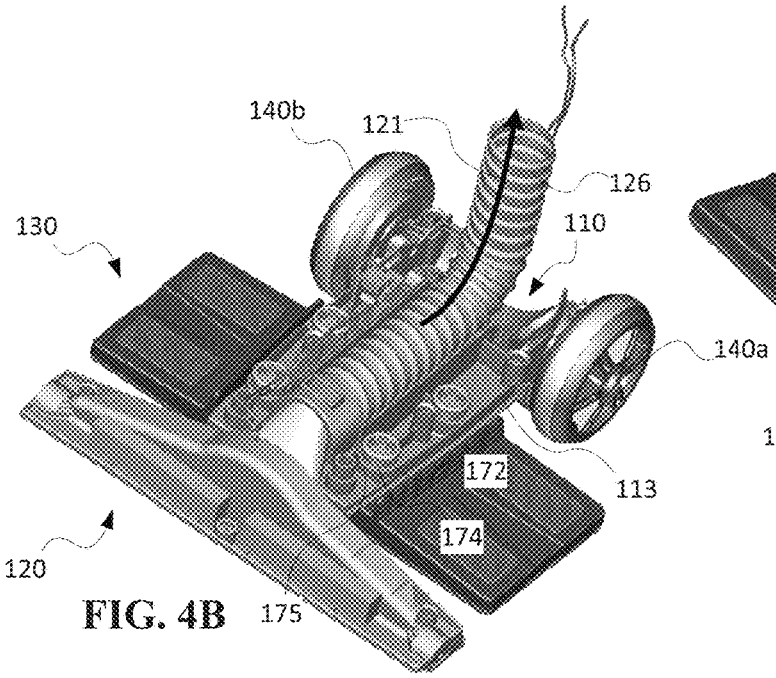
FIG. 4B is a perspective view of the vacuum cleaner attachment shown in FIG. 1A with a top portion removed.
Figure 4C:
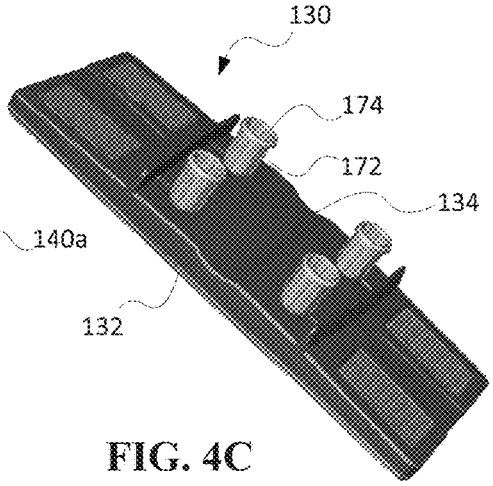
FIG. 4C is a perspective view of a floating surface cleaning element for use with the vacuum cleaner attachment shown in FIG. 1A.

In this embodiment of the vacuum cleaner attachment 100, the cleaning element support structure 130 is coupled to the housing 110 with a sliding coupling mechanism 170, as shown in FIGS. 4A-4C. The sliding coupling mechanism 170 includes one or more elongate members 172 (e.g., pins)

that slide within respective apertures 174 (e.g., defined by bushes 175). The elongate members 172 include stops 176 at the end of the elongate members 172 to limit movement. The illustrated embodiment shows the elongate members 172 extending from a top portion 134 of the support structure 130 and the apertures 174 and bushes 175 on a lower portion 113 of the housing 110. In other embodiments, one or more of the elongate members may extend from the lower portion 113 of the housing 110 and the apertures may be in the top portion 134 of the support structure 130.

Because the elongate members 172 slide within the apertures 176, the weight of the support structure 130 acts as a bias mechanism that biases the support structure 130 toward the surface 102 being cleaned but also allow the support structure 130 to float and adapt to changes in contours of the surface 102. As the cleaning element 132 on the cleaning element support structure 130 moves along the surface 102, a change in contour of the surface 102 (e.g., a raised portion 102*a* as shown in FIG. 4A) causes the support structure 130 to move such that the suction conduit 120, the cleaning element 132, and the wheels 140*a*, 140*b* may all remain in contact with the surface 102.

FIG. 4B also shows a hose 126 that defines the suction path 121 that extends from the suction conduit 120 to the neck 150. Debris first passes through the bottom opening 122 of the suction conduit 120 and into a dirty air inlet 124 (FIG. 4A) and then passes into the hose 126 (FIG. 4B). The hose 126 extends into the neck 150 and may be flexible to allow the neck 150 to pivot or swivel. Other conduits may also be used to define the suction path 121.

In some embodiments, a vacuum cleaner attachment with a floating cleaning element also includes bias mechanisms to further bias the cleaning element support structure 130 toward the surface 102 (e.g., in addition to the weight of the structure 130). FIGS. 5-8 show various example embodiments of bias mechanisms that may be used.

Figure 5:
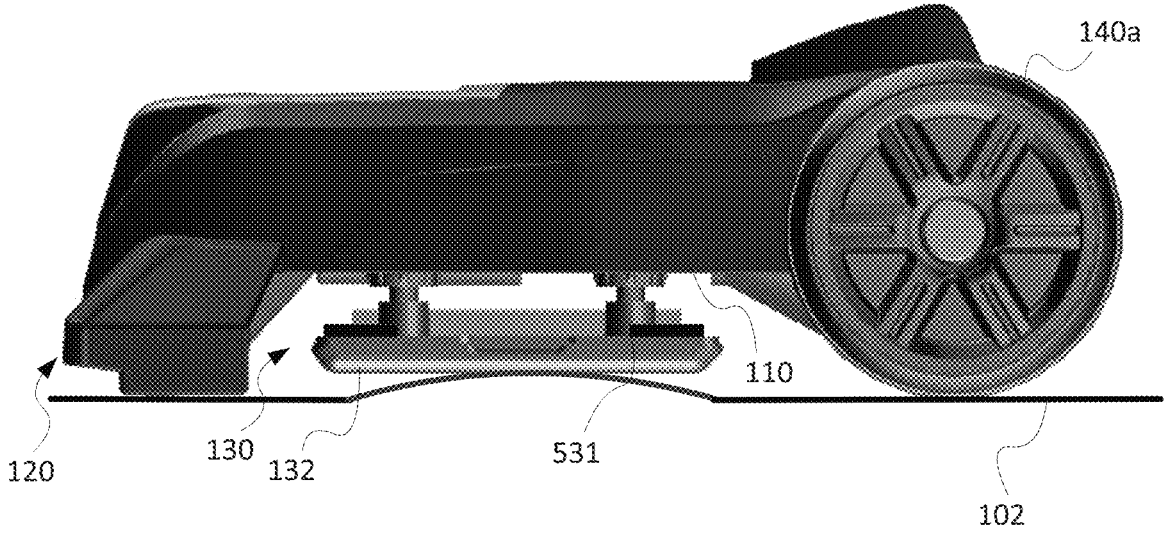
FIG. 5 is a side view of an embodiment of a vacuum cleaner attachment having a bias mechanism including a weighted material.

In one embodiment, shown in FIG. 5, a weighted material 531 further biases the support structure 130 toward the surface 102 by increasing the gravitational force. The weighted material 531 may be integrated with the support structure 106 or may be affixed to, or included within, the support structure 130. The weighted material 531 may be heavy enough to bias the support structure 130 away from the housing 110 such that the cleaning element 132 contacts the surface 102 and floats or adjusts to changes in the surface 102.

Figure 6:
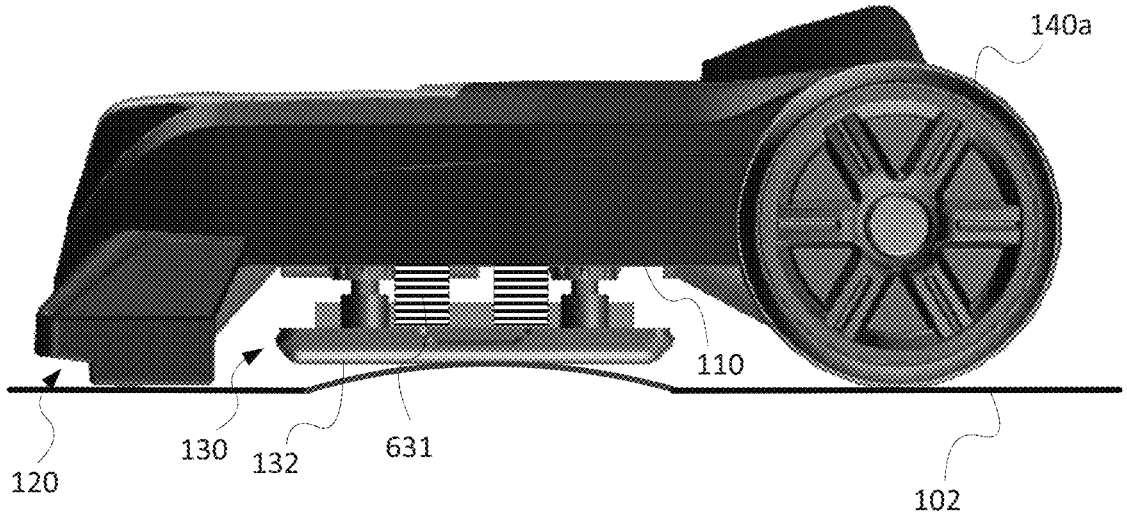
FIG. 6 is a side view of an embodiment of a vacuum cleaner attachment having a bias mechanism including a compression spring.
Figure 7:
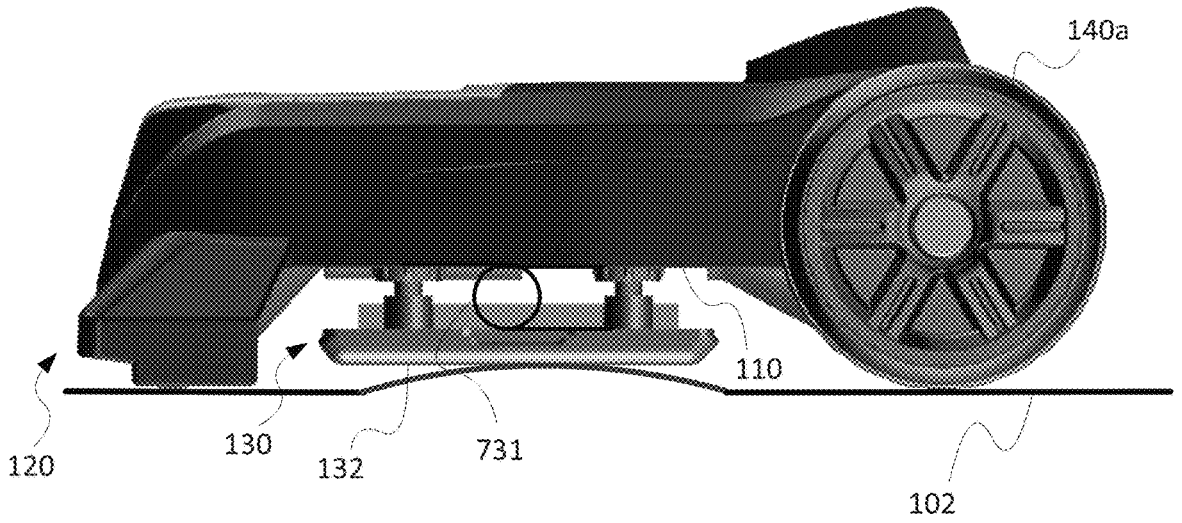
FIG. 7 is a side view of an embodiment of a vacuum cleaner attachment having a bias mechanism including a torsion spring.
Figure 8:
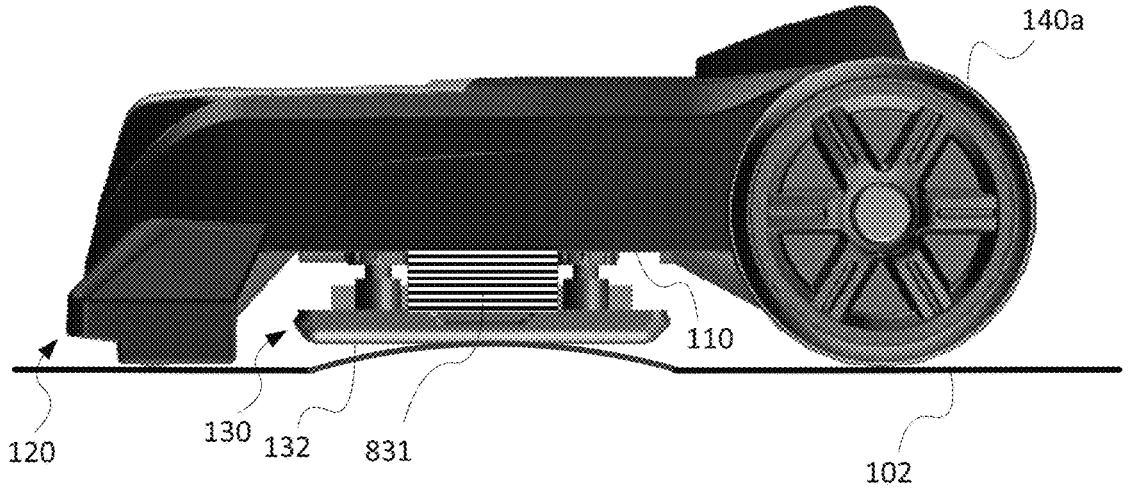
FIG. 8 is a side view of an embodiment of a vacuum cleaner attachment having a bias mechanism including a compliant material.

In other embodiments, shown in FIGS. 6-8, a bias mechanism, such as one or more compression springs 631 (FIG. 6), one or more torsion springs 731 (FIG. 7), and/or one or more compliant materials 831 (FIG. 8), may be located between the support structure 130 and the housing 110 to further bias the support structure 130 toward the surface 102. The compliant material(s) 831 may include, for example, an air bladder or foam. In other embodiments, other types of bias mechanisms may be used, for example, leaf springs or other types of springs. In each of these embodiments, the force exerted by the bias mechanism may be sufficient to maintain the cleaning element 132 in contact with the surface 102 but low enough to prevent the support structure 130 from raising the suction conduit 120 and/or the wheels 140*a*, 140*b* off of the surface 102. In one example, multiple bias mechanisms may be spaced in different locations on the support structure to apply the force evenly. For example, four (4) compression springs 631 may be located in four quadrants on the support structure 130.

In further embodiments, a second bias mechanism (also referred to as a suction conduit bias mechanism) may be used to bias the suction conduit 120 away from the neck 150 and down towards the surface 102. This improves contact between the suction conduit 120 and the surface 102, increasing the effectiveness of the suction in the suction conduit 120. The bias force exerted on the suction conduit 120 may be greater than the bias force exerted on the support structure 130 so that the support structure 130 may float with the surface 102.

Figure 9:
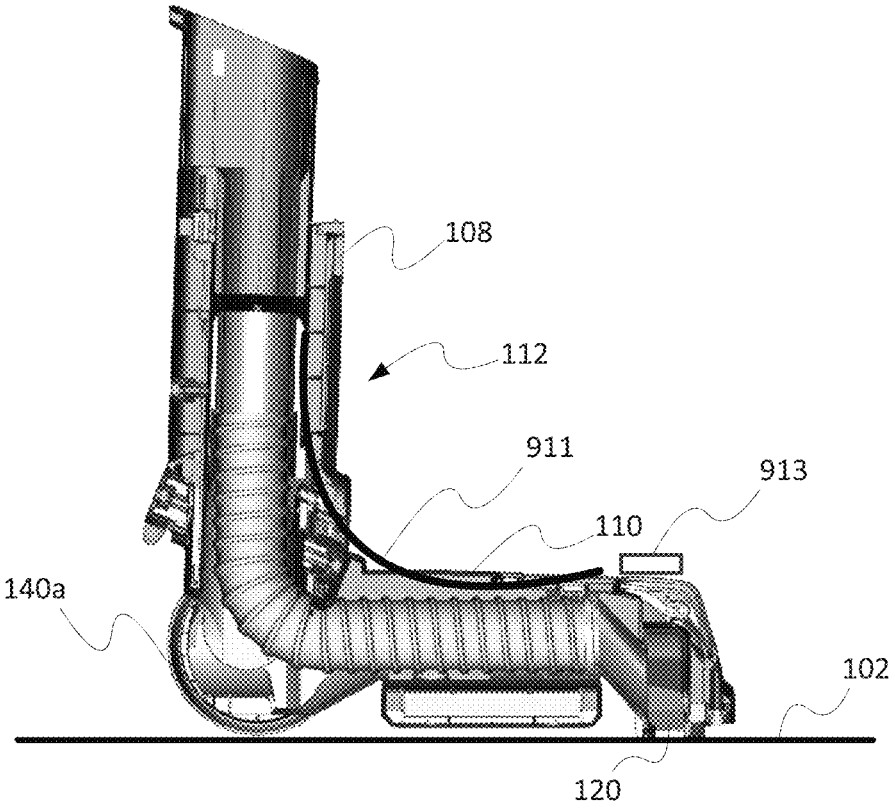
FIG. 9 is a cross-sectional view of a vacuum cleaner attachment including a suction conduit biasing mechanism, consistent with another embodiment of the present disclosure.

In one embodiment, as shown in FIG. 9, the second or suction conduit bias mechanism includes a torsion spring 911 coupled between the neck 150 and the housing 110. The torsion spring 911 operates by creating a moment (e.g., around an axle of the wheels 140*a*, 140*b*) that biases the suction conduit 120 towards the surface 102. Additionally or alternatively, the suction conduit bias mechanism may include a weighted material (which may be the weight of the housing 110 and/or a weight 913 attached to, or included with, the suction conduit 120). Other springs or bias mechanisms may also be used.

Figure 10:
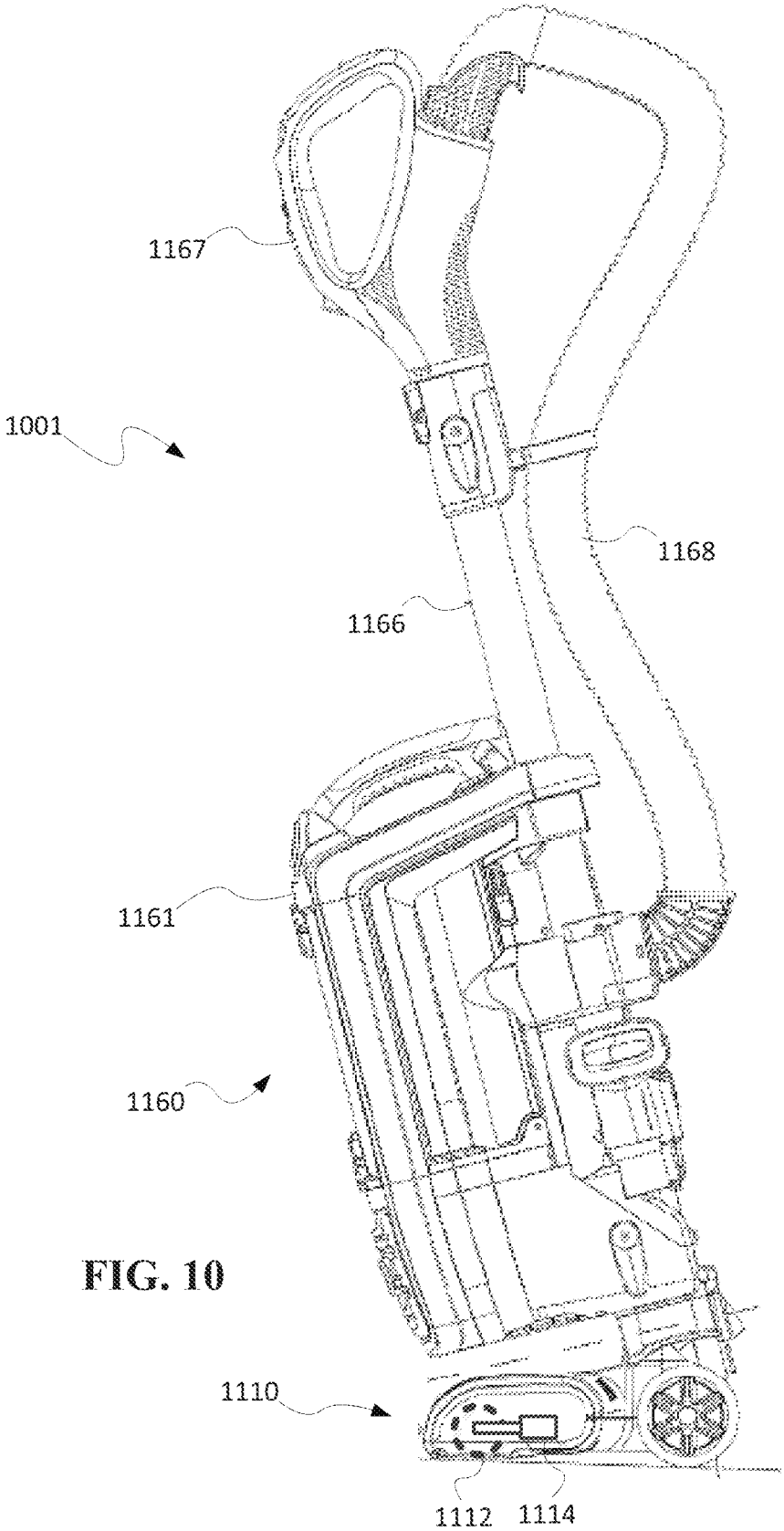
FIG. 10 is a side view of an upright canister vacuum cleaner including a main cleaning head that may be replaced with a vacuum cleaner attachment consistent with the present disclosure.

The vacuum cleaner attachment 100, consistent with embodiments disclosed herein, may be used as an alternate cleaning head for a vacuum cleaner 1001, for example, as shown in FIG. 10. The vacuum cleaner 1001 includes an upright section 1160 removably mounted to a main cleaning head 1110. In this embodiment, the main cleaning head 1110 includes a brush roll 1112 driven by a motor 1114 and is connected to a power source via the upright section 1160 for powering the motor 1114. The upright section 1160 may be removed from the main cleaning head 1110 and selectively connected to the vacuum cleaner attachment 100 as an alternate cleaning head. Alternatively, or additionally, the vacuum cleaner attachment 100 may be coupled to either a wand 1166 or a hose 1168 for use in an above floor cleaning mode.

Accordingly, the vacuum cleaner attachment with a floating cleaning element, consistent with embodiments of the present disclosure, may be used interchangeably with a main cleaning head to improve cleaning.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a vacuum attachment may embody any one or more of the features contained herein and that the features may be used in any particular combination or sub-combination. Modifications and substitutions by one of ordinary skill in the art are considered to be within the scope of the present invention, which is not to be limited except by the following claims.

What is claimed is:

1. A surface cleaning apparatus comprising:

a first surface cleaning head comprising:

a housing including a forward portion, a rear portion, and at least one suction conduit having at least one dirty air inlet;

a cleaning element support structure suspended below the housing and floating relative to the housing and suction conduit, the cleaning element support structure being configured to support a cleaning element;

a sliding coupling mechanism coupling the cleaning element support structure to the housing, the sliding coupling mechanism including at least one forward and at least one rearward elongate element configured to slidably engage a corresponding forward aperture and a rearward aperture, respectively, the forward elongate element and the forward aperture disposed on a forward portion of the support structure and/or the housing and the rearward elongate element and the rearward aperture disposed on a rearward portion of the support structure and/or the housing; and a first pair of wheels mounted for rotation on axles on opposite sides of the rear portion.

2. The surface cleaning apparatus of claim 1, further comprising:

a second cleaning head including a dirty air inlet;

an upright section selectively connectable to each of the first cleaning head and the second cleaning head, the upright section being movable between a storage position and a rearward in-use position, when mounted to each of the first cleaning head and the second cleaning head;

a flexible hose forming at least a portion of an airflow path and selectively connectable to the first cleaning head and the second cleaning head; and a suction motor and an air treatment system in fluid communication with the flexible hose and positioned in the airflow path.

3. The surface cleaning apparatus of claim 2, wherein the first cleaning head further comprises a neck pivotably connected to the housing.

4. The surface cleaning apparatus of claim 3, wherein the neck includes at least one mounting mechanism for mounting to the upright section.

5. The surface cleaning apparatus of claim 3, wherein the upright section includes a wand and a canister, and wherein the neck includes a first mounting mechanism for receiving the wand and a second mounting mechanism for receiving the canister.

6. The surface cleaning apparatus of claim 5, wherein the first mounting mechanism includes an opening at an end of the neck to receive the wand and the second mounting mechanism includes wings laterally extending from the neck to receive the canister.

7. The surface cleaning apparatus of claim 3, wherein the first cleaning head includes at least one light electrically coupled to the upright section when the first cleaning head is mounted thereto, and wherein the neck includes electrical connectors to mate with corresponding electrical connectors on the upright section.

8. The surface cleaning apparatus of claim 1, wherein the first pair of wheels and the at least one suction conduit are configured to contact a surface being cleaned, and wherein the cleaning element support structure is located between the at least one dirty air inlet and the first pair of wheels.

9. The surface cleaning apparatus of claim 1, further comprising at least a first bias mechanism configured to bias the cleaning element support structure away from the housing to allow the cleaning element support structure to float with respect to the housing during use on a surface being cleaned.

10. The surface cleaning apparatus of claim 9, wherein the first bias mechanism includes at least one spring.

11. The surface cleaning apparatus of claim 9, wherein the first bias mechanism includes at least a weighted material.

12. The surface cleaning apparatus of claim 9, wherein the first bias mechanism includes at least the weight of the support structure.

13. The surface cleaning apparatus of claim 9, further comprising a second bias mechanism configured to bias the at least one suction conduit toward a surface being cleaned.

14. The surface cleaning apparatus of claim 13, wherein the second bias mechanism is configured to bias the at least one suction conduit with a force greater than a force exerted by the first bias mechanism.

15. The surface cleaning apparatus of claim 1, wherein the at least one suction conduit further comprises at least one strip of bristles disposed on a bottom of the at least one suction conduit.

16. The surface cleaning apparatus of claim 1, wherein the at least one suction conduit further comprises at least one castellation disposed on a bottom of the at least one suction conduit.

17. The surface cleaning apparatus of claim 16, wherein the at least one suction conduit further comprises a plurality of bristles disposed on the at least one castellation.

18. The surface cleaning apparatus of claim 1, wherein the at least one suction conduit further comprises at least one cleaning pad disposed on a bottom of the at least one suction conduit.

19. A surface cleaning apparatus comprising:

a first surface cleaning head comprising:

a housing including at least one suction conduit having at least one dirty air inlet;

a cleaning element support structure suspended below the housing and floating relative to the housing and suction conduit, the cleaning element support structure being configured to support a cleaning element;

a sliding coupling mechanism coupling the cleaning element support structure to the housing, the sliding coupling mechanism including at least one elongate element and at least one aperture, the at least one elongate member being disposed on at least one of the cleaning element support structure and the housing and slidably engaging the at least one aperture on the other of the support structure and the housing, wherein the at least one elongate element includes a stop at a distal end thereof to maintain engagement between the support structure and the housing.

20. The surface cleaning apparatus of claim 19, wherein:

the at least one aperture includes at least one forward aperture and at least one rearward aperture;

the at least one elongate member includes at least one rearward elongate element and at least one forward elongate element configured to slidably engage the forward aperture and the rearward aperture, respectively; and wherein the forward elongate element and the forward aperture are disposed on a forward portion of the support structure and/or the housing and the rearward elongate element and the rearward aperture are disposed on a rearward portion of the support structure and/or the housing.

21. The surface cleaning apparatus of claim 20, further comprising at least a first bias mechanism configured to bias the cleaning element support structure away from the housing to allow the cleaning element support structure to float with respect to the housing during use on a surface being cleaned.

22. The surface cleaning apparatus of claim 21, wherein the first bias mechanism includes at least one spring.

23. The surface cleaning apparatus of claim 21, further comprising a second bias mechanism configured to bias the at least one suction conduit toward a surface being cleaned.

24. The surface cleaning apparatus of claim 23, wherein the second bias mechanism is configured to bias the at least one suction conduit with a force greater than a force exerted by the first bias mechanism.

* * * * *